US006545649B1

(12) United States Patent
Seavey

(10) Patent No.: US 6,545,649 B1
(45) Date of Patent: Apr. 8, 2003

(54) LOW BACKLOBE VARIABLE PITCH QUADRIFILAR HELIX ANTENNA SYSTEM FOR MOBILE SATELLITE APPLICATIONS

(75) Inventor: John M. Seavey, Cohasset, MA (US)

(73) Assignee: Seavey Engineering Associates, Inc., Pembroke, MA (US)

( * ) Notice: Subject to any disclaimer, the term of this patent is extended or adjusted under 35 U.S.C. 154(b) by 0 days.

(21) Appl. No.: 10/000,420

(22) Filed: Oct. 31, 2001

(51) Int. Cl.[7] ..... H01Q 1/36; H01Q 1/24
(52) U.S. Cl. ..... 343/895; 343/713; 343/850
(58) Field of Search ..... 343/895, 713, 343/702, 850, 853, 860

(56) References Cited

U.S. PATENT DOCUMENTS 3,906,509 A * 9/1975 DuHamel ..... 343/895
5,635,945 A * 6/1997 McConnell et al. ..... 343/895
5,872,549 A * 2/1999 Huynh et al. ..... 343/895
5,892,480 A * 4/1999 Killen ..... 343/895
5,920,292 A * 7/1999 O'Neill, Jr. ..... 343/895
6,133,891 A * 10/2000 Josypenko ..... 343/895
6,229,498 B1 * 5/2001 Matsuyoshi et al. ..... 343/895
6,246,379 B1 * 6/2001 Josypenko ..... 343/895
6,295,033 B1 * 9/2001 Chatzipetros et al. ..... 343/713
6,340,954 B1 * 1/2002 Annamaa et al. ..... 343/895
6,344,834 B1 * 2/2002 Josypenko ..... 343/895

* cited by examiner

*Primary Examiner*—Hoang Nguyen
(74) *Attorney, Agent, or Firm*—Kenneth W. Float

(57) ABSTRACT

A quadrifilar helix antenna system that is wound with a helical structure that changes pitch towards top of the antenna. An exemplary antenna system has first and second bifilar helical loops that each comprise a pair of orthogonal windings disposed around a common central axis. Each loop has a winding pitch that varies along the axis to achieve backlobe radiation suppression from the antenna system. First and second terminals are coupled to respective top ends of the bifilar helical loops. The terminals may be fed in phase quadrature by a quadrature hybrid. The antenna system may also include short circuit coupled to respective bottom ends the first and second bifilar helical loops. The antenna system is preferably used in vehicle-to-satellite mobile communication applications.

23 Claims, 3 Drawing Sheets

LOW BACKLOBE VARIABLE PITCH QUADRIFILAR HELIX ANTENNA SYSTEM FOR MOBILE SATELLITE APPLICATIONS

BACKGROUND

The present invention relates generally to mobile satellite antenna systems, and more particularly, to a top-fed variable pitch omnidirectional quadrifilar helix antenna system for use in mobile satellite applications.

It is highly desirable that antennas used in mobile satellite applications have an omnidirectional radiation pattern shaped to receive signals only at elevations of the satellite(s) with which they are employed. The satellites that typically operate with the mobile equipment are located at elevation angles above 25–30 degrees. The gain of the antenna system should be maximized above this lower elevation limit up to zenith. At the same time gain of the antenna system should be reduced below the horizon. Heretofore, no antennas have been available that meet all of these requirements.

The basic form of a resonant quadrifilar helix antenna was published in December 1970 in "The Microwave Journal". Since its initial development, research has been performed that vary the number of turns along with the length and diameter ratios. All of these factors affect the radiation pattern produced by the antenna. Conventional fractional turn design produces a cardioid radiation pattern. A tall narrow quadrifilar helix antenna exhibits a shaped-conical pattern with high grain to the horizon and decreased gain overhead, which is well suited to ground applications. Published data and designs regarding narrow antennas indicate that they are better suited to UHF applications.

It is therefore an objective of the present invention to provide for a top-fed variable pitch omnidirectional quadrifilar helix antenna system for use in mobile satellite applications.

The present invention provides for a top-fed quadrifilar helix antenna system which is wound with a special helical structure that changes pitch toward the top of the antenna. An exemplary top-fed quadrifilar helix antenna system includes first and second bifilar helical loops that each comprise a pair of orthogonal windings disposed in a mutual orthogonal relationship relative to a common central axis. Each loop is configured to have a winding pitch that varies along the cylindrical axis so as to suppress backlobe radiation from the antenna system.

First and second terminals are coupled to respective top ends of the bifilar helical loops. The first and second terminals may be fed using two sources, one for each pair of orthogonal windings of the first and second bifilar helical loops. This is preferable when the antenna system is used in satellite communication applications.

Each bifilar helical loop preferably comprises lower, intermediate, and upper sections whose pitch decreases from lower to upper. The antenna system may also include short circuits coupled to respective bottom ends the first and second bifilar helical loops.

The winding scheme significantly reduces the so-called "backlobe" radiation in the lower hemisphere. The backlobe angular region lies between −25 degrees and nadir. By reducing the backlobes, the antenna system may be placed and deployed on a wide range of vehicles, structures or mounting surfaces without suffering effects of scattering, reflections and coupling. These deleterious effects can greatly reduce the gain of the antenna in the upper hemisphere and cause problems with mobile satellite radio or communications equipment.

When using the present winding scheme, it is necessary to suppress both senses of circular polarization in the backlobe angular regions since circularly-polarized signals reverse their polarization sense when reflected from metal objects.

In mobile satellite applications, reflections from metal objects underneath the antenna system can act to cancel the desired direct signal from a satellite. This can greatly degrade a mobile satellite terminal's performance.

Standard quadrifilar helix antenna systems have a backlobe that is oppositely sensed to the upper radiation. The present invention mitigates this effect.

The present quadrifilar helix antenna system was developed for use in a mobile satellite communications system. The quadrifilar helix antenna system receives digital signals from stationary or orbiting satellites in the 2.3 GHz frequency band.

The quadrifilar helix antenna system may be mounted to the exterior of many classes of vehicles including trucks, trains, cars, boats and other mobile or portable equipment. The quadrifilar helix antenna system may also be mounted to fixed structures.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1B:
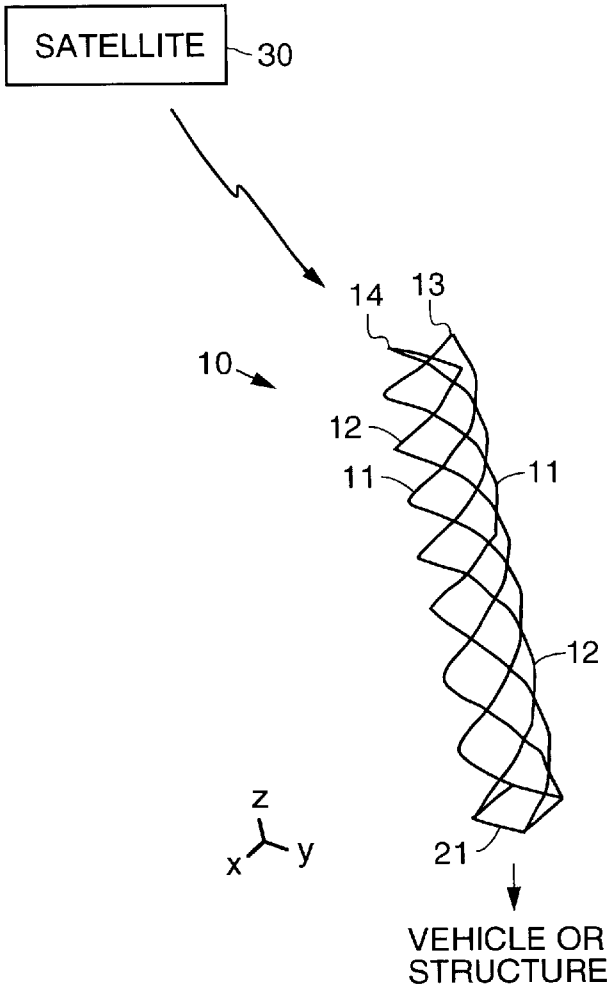
FIGS. 1*a* and 1*b* illustrate front and side views, respectively, of an exemplary top-fed variable pitch omnidirectional quadrifilar helix antenna system in accordance with the principles of the present invention.
Figure 1A:
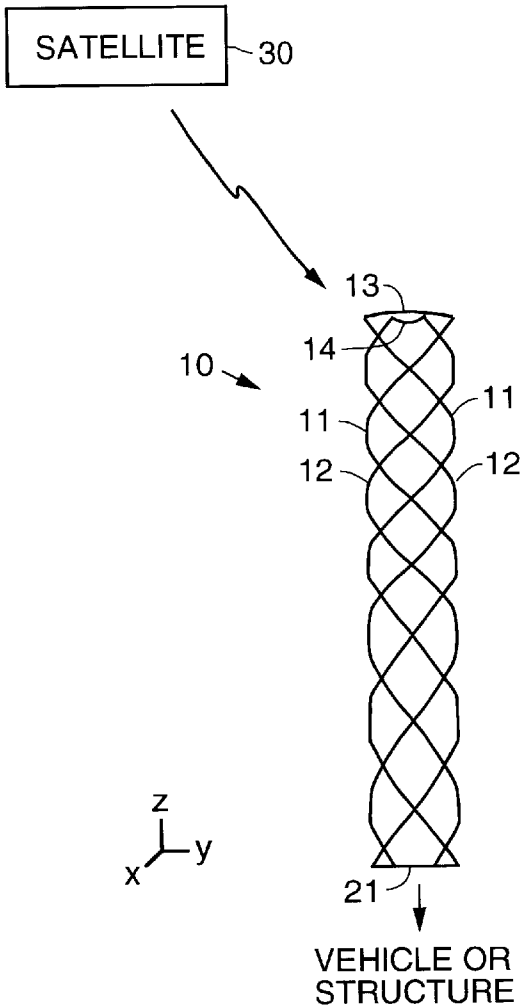

Referring to the drawing FIGS. 1*a* and 1*b* illustrate front and side views, respectively, of a top-fed variable pitch omnidirectional quadrifilar helix antenna system 10 in accordance with the principles of the present invention. The present antenna system 10 may be advantageously used in mobile satellite applications.

The top-fed variable pitch omnidirectional quadrifilar helix antenna system 10 is a generally cylindrical structure composing first and second bifilar helical loops 11, 12 that are oriented in a mutual orthogonal relationship relative to a common central axis of the antenna system 10. Each bifilar helical loop 11, 12 comprises a pair of orthogonal windings.

The first and second bifilar helical loops 11, 12 of the top-fed quadrifilar helix antenna system 10 are each wound with a helical structure that changes pitch towards the top of the antenna system 10. The pitch of each of the bifilar helical loops 11, 12 become finer as they approach the top of the antenna system 10.

To achieve the variable pitch along the length of the antenna system 10, there are three sections of the antenna system 10, namely lower, intermediate, and upper sections.

Each of the respective sections has a different pitch, which will be detailed hereinbelow.

First and second terminals 13, 14 (or feed points 13, 14) are provided at the top of the antenna system 10 that respectively interconnect the first and second bifilar helical loops 11, 12. The first and second bifilar helical loops 11, 12 are shorted 15 at the bottom of the antenna system 10. The terminals 13, 14 of each loop 11, 12 are generally fed in antiphase and the currents in the two loops 11, 12 are in phase quadrature.

Figure 6:
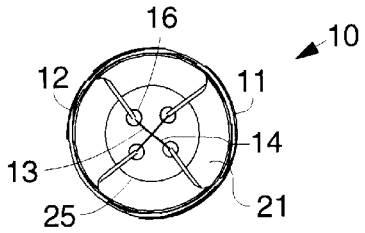
FIGS. 5–7 illustrate perspective, top and side views, respectively, of a reduced-to-practice embodiment of a top-fed variable pitch omnidirectional quadrifilar helix antenna system in accordance with the principles of the present invention.
Figure 7:
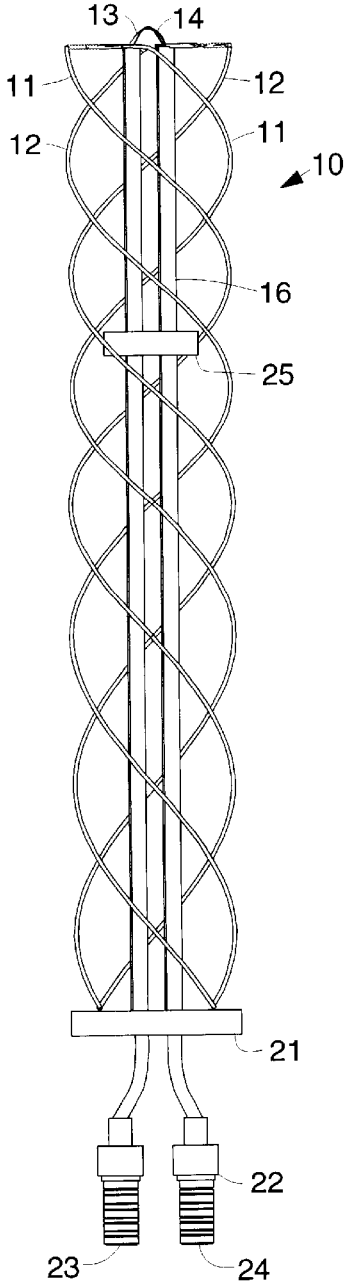
Figure 5:
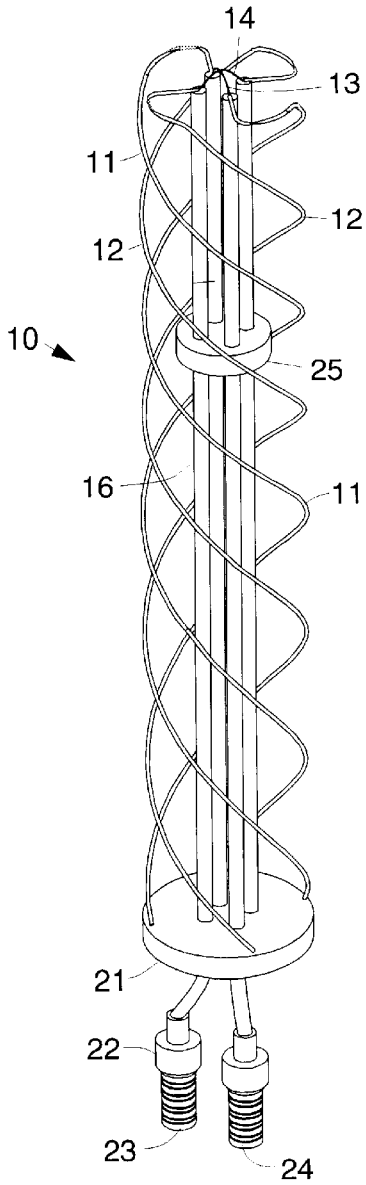

However, the terminals 13, 14 of each loop 11, 12 (or pair of orthogonal windings) may be fed by two sources, one for each pair of orthogonal windings. This is illustrated in a reduced-to-practice embodiment of the antenna system 10 which is shown in FIGS. 5–7.

Figure 2:
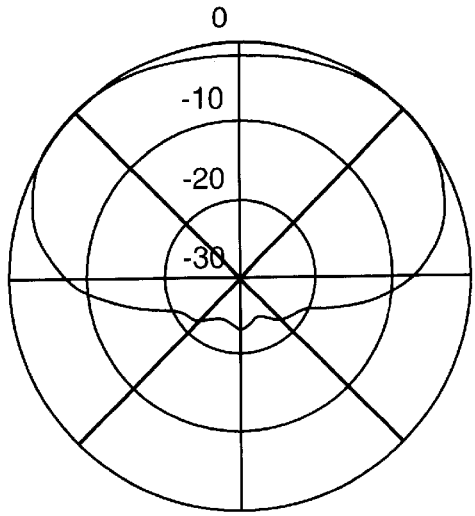
FIGS. 2–4 depict radiation patterns of the to antenna system shown in FIG. 1.
Figure 3:
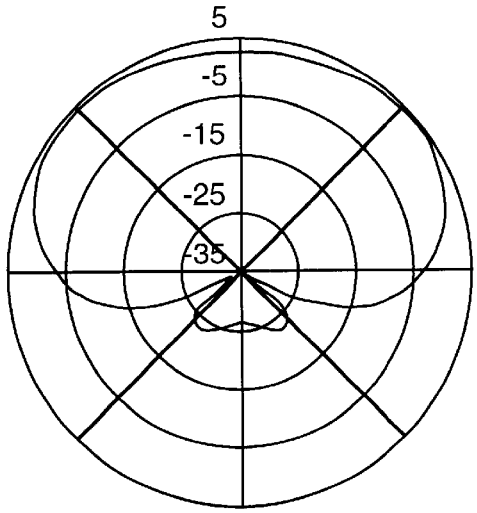
Figure 4:
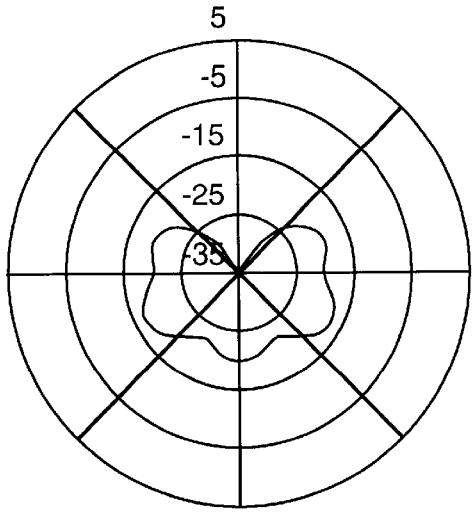

The variable pitch configuration of the loops 11, 12 generates a very desirable radiation pattern for the antenna system 10. FIGS. 2–4 depict radiation patterns of the reduced-to-practice embodiment of the top-fed variable pitch omnidirectional quadrifilar helix antenna system 10 shown in FIG. 1. These illustrations show the fundamental and significant aspects of the antenna system 10.

More particularly, FIG. 2 shows the total power radiated by the antenna system 10 in an elevational plane. The azimuth plane is omnidirectional. FIG. 3 shows a left-hand circular polarized component. FIG. 4 shows a right-hand circular polarized component.

The winding scheme of the first and second bifilar helical loops 11, 12 significantly reduces backlobe radiation in the lower hemisphere. The backlobe angular region lies between −25 degrees and nadir. This should be clear from looking at the radiation patterns shown in FIGS. 2 and 3.

FIGS. 5–7 illustrate perspective, top and side views, respectively, of a reduced-to-practice embodiment of a top-fed variable pitch omnidirectional quadrifilar helix antenna system 10 in accordance with the principles of the present invention. In addition to the components described with reference to FIGS. 1 and 2, the reduced-to-practice embodiment of the top-fed variable pitch omnidirectional quadrifilar helix antenna system 10 comprises a base 21, which may be round, and to which bottom ends of the first and second bifilar helical loops 11, 12 are coupled, and which provides the short 15 at the bottom of the antenna system 10.

A pair of coaxial connectors 22 are coupled to coaxial wires 16 that extend through the base 21 to the tip of the antenna 10. The coaxial connectors 22 comprises first and second input ports 23, 24 for the antenna system 10. The coaxial connectors 22 are coupled by way of coaxial wires 16 to the first and second terminals 13, 14 (or feed points 13, 14) at the top of the antenna system 10.

The first and second terminals 13, 14 (or feed points 13, 14) at the top of the antenna system 10 comprise wires that interconnect windings of the first and second bifilar helical loops 11, 12. A balun short plate 25 is disposed approximately one-third of the way down the length of the antenna system 10 from the top.

The first and second input ports 23, 24 are generally connected to a quadrature hybrid (not shown). It is well-understood by those skilled in the art that the two ports 23, 24 are to be combined in phase quadrature and equal amplitude by means of the quadrature hybrid.

The antenna system 10 has only one port 23, 24 that is optional. It is the port of the quadrature hybrid that creates the appropriate phase shift for the winding sense of the helical loops 11, 12 or wires. A fourth port of the quadrature hybrid is normally terminated in a matched load. All of this is well-understood by practitioners skilled in the antenna art.

By reducing backlobes produced by the antenna system 10, the antenna system 10 may be advantageously used on a wide range of vehicles, structures or mounting surfaces without suffering effects of scattering, reflections and coupling. These deleterious effects can greatly reduce the gain of the antenna system 10 in the upper hemisphere and cause problems with mobile satellite radio or communications equipment.

When using the present winding scheme to reduce the backlobes, it is necessary to suppress both senses of circular polarization in the backlobe angular regions since circularly-polarized signals reverse their polarization sense when reflected from metal objects. The suppression of both senses of circular polarization is illustrated in FIG. 4.

In mobile satellite applications, for example, reflections from metal objects underneath the antenna system 10 can act to cancel the desired direct signal from a satellite. This can generally degrade the performance of the mobile satellite terminal.

The quadrifilar helix antenna system 10 was developed for use in a mobile satellite communications system. The quadrifilar helix antenna system 10 receives digital signals from stationary or orbiting satellites in the 2.3 GHz frequency band.

The quadrifilar helix antenna system 10 may be mounted to the exterior of many classes of vehicles, including trucks, trains, cars, boats and other mobile or portable equipment. For example, the quadrifilar helix antenna system 10 may be preferably mounted on the exterior of automotive vehicle glass and utilized as a satellite communications antenna. The quadrifilar helix antenna system 10 may also be mounted to fixed structures.

A preferred and reduced-to-practice embodiment of the antenna system 10, such as is illustrated in FIGS. 5–7, for example, which may be advantageously used in a mobile satellite application has the following specifications:

| | |
|---|---|
| Frequency: | 2.3200–2.3325 GHz |
| Polarization: | LHCP |
| Gain: | +3.0 dBic for all azimuths above 30° elevation |

The preferred and reduced to practice embodiment of the antenna system 10 also has the following physical attributes:

| | |
|---|---|
| Diameter, inches: | 0.85 |
| Minimum gain above 30ø.dBic: | 3.4 |
| Minimum backlobe suppresion, dB(at 180 degrees): | −27 |
| Winding turns: | 1 7/8 |
| Pitch, lower section, inches: | 0.8 |
| Pitch, intermediate section, inches: | 0.7 |
| Pitch, upper section, inches: | 0.6 |
| Feed points (2): | Top |
| Shorts (2): | Bottom |

Exact height coordinates (measured from the top) for the reduced to practice embodiment of the antenna system 10 are as follows:

| Turn | Height, inches |
|---|---|
| 0.000 | 0.00 |
| 0.125 | −0.30 |
| 0.250 | −0.60 |
| 0.375 | −0.90 |
| 0.500 | −1.20 |
| 0.625 | −1.50 |
| 0.750 | −1.80 |
| 0.875 | −2.10 |
| 1.000 | −2.40 |
| 1.125 | −2.75 |
| 1.250 | −3.10 |
| 1.375 | −3.50 |
| 1.500 | −3.90 |
| 1.625 | −4.30 |
| 1.750 | −4.70 |
| 1.875 | −5.05 |

Thus, an improved top-fed variable pitch omnidirectional quadrifilar helix antenna system has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention. For example, the dimensions and parameters of the antenna system may be readily sealed for different frequency ranges and applications.

What is claimed is:

1. A quadrifilar helix antenna system comprising:

first and second bifilar helical loops that each comprise a pair of orthogonal windings disposed in a mutual orthogonal relationship relative to a common central axis, wherein each loop is configured to have a winding pitch that varies along the cylindrical axis so as to suppress backlobe radiation from the antenna system; and first and second terminals coupled to respective top ends of the bifilar helical loops.

2. The quadrifilar helix antenna system recited in claim 1 wherein the pitch of each bifilar helical loop is finer towards the top of the antenna system.

3. The quadrifilar helix antenna system recited in claim 1 wherein each bifilar helical loop comprises lower, intermediate, and upper sections whose pitch decreases from lower to upper.

4. The quadrifilar helix antenna system recited in claim 1 wherein the first and second terminals are fed in antiphase and the currents in the loops are in phase quadrature.

5. The quadrifilar helix antenna system recited in claim 1 wherein the first and second terminals are fed in phase quadrature.

6. The quadrifilar helix antenna system recited in claim 5 which is coupled to an exterior surface of a window of a vehicle and comprises a satellite communications antenna.

7. The quadrifilar helix antenna system recited in claim 1 further comprising short circuits coupled to respective bottom ends the first and several bifilar helical loops.

8. The quadrifilar helix antenna system recited in claim 7 which is coupled to an exterior surface of a window of a vehicle and comprises a satellite communications antenna.

9. The quadrifilar helix antenna system recited in claim 1 which is coupled to an exterior surface of a window of a vehicle and comprises a satellite communications antenna.

10. A top-fed variable pitch omnidirectional quadrifilar helix antenna system comprising:

first and second bifilar helical loops that each comprise a pair of orthogonal windings disposed in a mutual orthogonal relationship relative to a common central axis, wherein each loop is configured to have a winding pitch that varies along the cylindrical axis so as to suppress backlobe radiation from the antenna system; and first and second terminals coupled to respective top ends of the bifilar helical loops, which terminals are fed in phase quadrature.

11. The system recited in claim 10 wherein the pitch of each bifilar helical loop is finer towards the top of the antenna system.

12. The system recited in claim 10 wherein each bifilar helical loop comprises lower, intermediate, and upper sections whose pitch decreases from lower to upper.

13. The system recited in claim 10 wherein the first and second terminals are fed in antiphase and the currents in the loops are in phase quadrature.

14. The system recited in claim 10 further comprising short circuits coupled to respective bottom ends the first and second bifilar helical loops.

15. The system recited in claim 14 which is coupled to an exterior surface of a window of a vehicle and comprises a satellite communications antenna.

16. The system recited in claim 10 which is coupled to an exterior surface of a window of a vehicle and comprises a satellite communications antenna.

17. A top-fed variable pitch omnidirectional quadrifilar helix antenna system comprising:

first and second bifilar helical loops that each comprise a pair of orthogonal windings disposed in a mutual orthogonal relationship relative to a common central axis, wherein each loop is configured to have a winding pitch that varies along the cylindrical axis so as to suppress backlobe radiation from the antenna system;

first and second terminals coupled to respective top ends of the bifilar helical loops; and short circuits coupled to respective bottom ends the first and second bifilar helical loops.

18. The quadrifilar helix antenna system received in claim 17 wherein the pitch of each bifilar helical loop is finer towards the top of the antenna system.

19. The quadrifilar helix antenna system recited in claim 17 wherein each bifilar helical loop comprises lower, intermediate, and upper sections whose pitch decreases from lower to upper.

20. The quadrifilar helix antenna system recited in claim 17 wherein the first and second terminals are fed in antiphase and currents in the loops are in phase quadrature.

21. The quadrifilar helix antenna system recited in claim 17 wherein the first and second terminals are fed in phase quadrature.

22. The system recited in claim 21 which is coupled to an exterior surface of a window of a vehicle and comprises a satellite communications antenna.

23. The system recited in claim 17 which is coupled to an exterior surface of a window of a vehicle and comprises a satellite communications antenna.

* * * * *